United States Patent [19]

Kamisada

[11] Patent Number: 4,725,702

[45] Date of Patent: Feb. 16, 1988

[54] MINIATURE SWITCH WITH SELF-ALIGNING MOVABLE CONTACTOR

[76] Inventor: Koji Kamisada, c/o Nihon Kaiheiki Industrial Company Ltd; 5-14, Minamimagome 1-chome, Ohta-ku, Tokyo, Japan

[21] Appl. No.: 22,616

[22] Filed: Mar. 4, 1987

Related U.S. Application Data

[63] Continuation of Ser. No. 826,036, Feb. 4, 1986, abandoned.

[30] Foreign Application Priority Data

Apr. 4, 1985 [JP] Japan ..... 60-49247[U]

[51] Int. Cl.[4] ..... H01H 1/42

[52] U.S. Cl. ..... 200/254; 200/282; 200/163; 200/286; 200/16 F

[58] Field of Search ..... 200/15, 16 R, 16 F, 200/162, 163, 252, 254, 255, 256, 257, 258, 282, 281, 339, 340, 286, 287; 319/217

[56] References Cited

U.S. PATENT DOCUMENTS

| | | | |
|---|---|---|---|
| 3,735,077 | 5/1973 | Ohashi | 200/315 |
| 4,013,857 | 3/1977 | Tanaka | 200/315 |
| 4,075,442 | 2/1978 | Fukuda et al. | 200/16 F |
| 4,086,546 | 4/1978 | Fulp et al. | 200/16 F X |
| 4,122,317 | 10/1978 | Shimamune et al. | 200/16 F |
| 4,239,950 | 12/1980 | Hinze et al. | 200/254 |
| 4,324,958 | 4/1982 | Valleau | 200/16 F |
| 4,371,767 | 2/1983 | Ohashi et al. | 200/335 |
| 4,433,222 | 2/1984 | Kodaira | 200/153 J |

FOREIGN PATENT DOCUMENTS

| | | | |
|---|---|---|---|
| 3442173 | 4/1985 | Fed. Rep. of Germany | 200/163 |
| 597702 | 1/1979 | Japan . | |

*Primary Examiner*—Henry J. Recla
*Assistant Examiner*—Ernest G. Cusick

[57] ABSTRACT

A miniature switch has an actuator block operated by a toggle lever and formed to include a recess in one side face thereof, the recess being open at its bottom and on one side and having a retaining portion. The upper part of a movable contactor is provided with an engagement portion loosely fitted into the retaining portion of the actuator block to mount the contactor in the actuator block. The arrangement is such that when the actuator block is covered by a switch housing, the inner wall surface of the housing is situated at the side of the movable contactor to prevent the movable contactor from becoming detached from the actuator block.

4 Claims, 8 Drawing Figures

MINIATURE SWITCH WITH SELF-ALIGNING MOVABLE CONTACTOR

This application is a continuation of application Ser. No. 826,036 filed 2/4/86 now abandoned.

BACKGROUND OF THE INVENTION

This invention relates to a miniature switch and, more particularly, to a miniature electric switch having a self-alignment type movable contactor.

A principle portion of a conventional miniature switch shown in FIG. 1 includes an actuator block 1 operated by a toggle lever (not shown), a clip-shaped movable contactor 2 consisting of a resilient metal plate mounted in the actuator block 1, and a stationary terminal 3 with which the movable contactor 2 makes and breaks contact. The lower surface of the actuator block 1 is formed to include a rectangular recess 1-1, and the clip-shaped movable contactor 2 includes a projection 2-1 corresponding to the rectangular recess 1-1. To mount the movable contactor 2 in the actuator 1, the projection 2-1 is press-fitted into the recess 1-1 from the lower side of the actuator block 1 to engage the inner wall of the recess.

When the movable contactor 2 is thus mounted in the actuator block 1 by press-fitting, as shown in FIG. 1, there are occasions where the movable contactor 2 becomes detached from the actuator block 1 during operation of the switch, thus resulting in poor contact between the movable contactor 2 and stationary contact 3. On the other hand, if the fit between the movable contactor 2 and actuator block 1 is so tight that the two can be fitted together only by exerting great force, the movable contactor 2 is likely to be deformed during the press-fitting operation, and adjusting the fit between them is difficult.

In another example of the prior-art disclosed in, for example, the specification of Japanese Utility Model Publication No. 59-7702 and illustrated in FIGS. 2 and 3, a miniature slide switch includes a slider 4 the main body of which is provided with a plurality of recesses, a clip-shaped movable contactor 5 accommodated in each of the recesses, and a plurality of stationary terminals 8 implanted in an insulating base 7 fixed by a frame 6. By moving the slider 4, each movable contactor 5 is slid successively from one stationary terminal 8 to the next. With the slide switch of this type, however, the movable contactor 5 tends to become skewed and to separate from the stationary terminals 8 when the switch is operated. Preventing this from occurring necessitates means such as a slitted slide strip 9 provided on the insulating base 7. The problem with this arrangement is that achieving the proper positional alignment between the slide strip 9 and both the stationary terminals 8 and movable contactor 5 is a troublesome task. If the movable contactor 5 undergoes any positional displacement, moreover, the slider 4 no longer travels smoothly. The result is diminished operability. Furthermore, providing the slide strip 9 complicates the overall structure of the switch and naturally increases the number of component parts.

SUMMARY OF THE INVENTION

An object of the present invention is to provide a miniature switch in which a movable contactor can be mounted with ease in an actuator block operated by a lever means, and in which the movable contactor is retained reliably by the actuator block.

Another object of the present invention is to provide a miniature switch exhibiting excellent operability in which stable contact is assured between a movable contactor and stationary contacts.

Still another object of the present invention is to provide a miniature switch of lower cost and smaller size achieved by reducing the number of component parts.

According to the present invention, the foregoing objects are attained by providing a miniature switch comprising a base having a plurality of stationary contacts fixedly implanted therein, a switch housing fixedly secured to the base, an actuator block operated by lever means and covered by the switch housing, and a movable contactor mounted in the actuator block for being brought into and out of sliding contact with prescribed ones of the stationary contacts. The actuator block is provided with a recess having a side opening, which recess includes a retaining portion. The movable contactor has, at its upper part, an engagement portion slidably engaged with the retaining portion of the recess to mount the movable contactor in the actuator block in such a manner that the inner wall surface of the switch housing is situated on the outer side of the movable contactor.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

Figure 4:
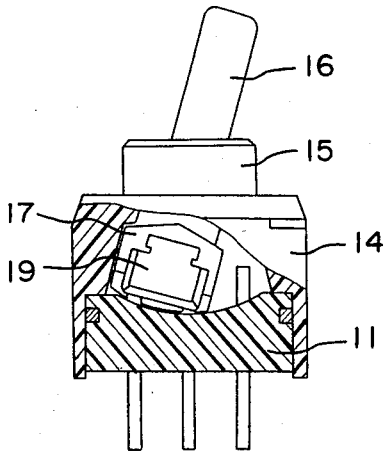
FIG. 4 is a front view, partly in section, showing a first embodiment of a miniature switch according to the present invention.
Figure 5:
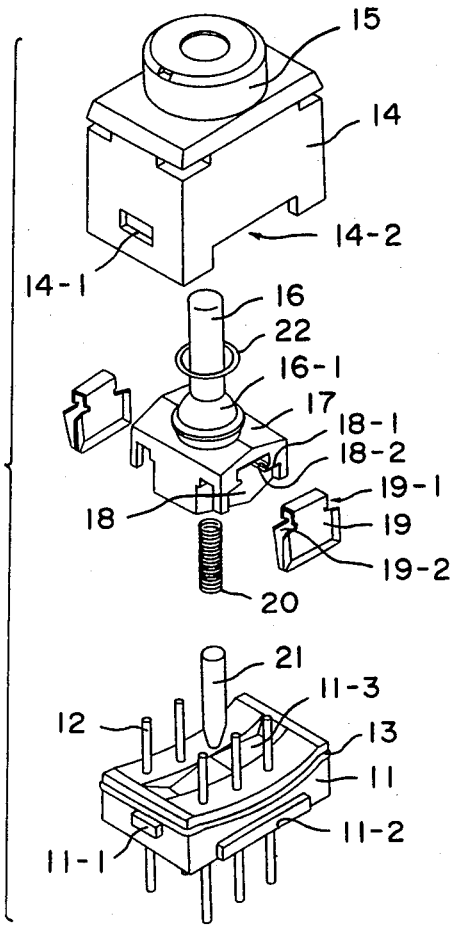
FIG. 5 is an exploded perspective view of the miniature switch shown in FIG. 4.
Figure 6:
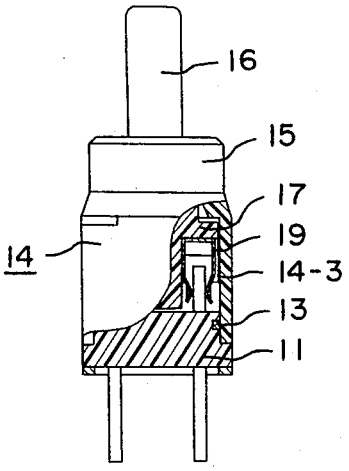
FIG. 6 is a side view, partly broken away, of the miniature switch shown in FIG. 4.

An embodiment of a miniature switch according to the present invention and illustrated in FIGS. 4 through 6 includes a switch housing 14 formed to include a fitting hole 14-1 and a fitting recess 14-2, and a base 11 in which a linear row of plural stationary contacts 12 are fixedly implanted, and which is formed to include fitting projections 11-1, 11-2 fitted respectively into the hole 14-1 and recess 14-2 of the housing 14, as well as a cam surface 11-3 for quick-stop action in cooperation with a plunger 21, described below. An O-ring 13 is attached to the outer periphery of base 11. Provided on the upper portion of the housing 14 is an upwardly extending bushing 15 having a circular bore for receiving a toggle lever 16. The lower end of the toggle lever 16 extending into the housing 14 is formed to include an expanded portion 16-1 connected to an actuator block 17. The actuator block 17 has a side face provided with a recess 18 having a side opening. The upper part of the recess 18 is formed to include a step 18-1 provided with a retaining portion 18-2 projecting therefrom. A movable contactor 19 is fixedly mounted in the recess 18, as will be described below in greater detail. Note that if the recess 18 is provided in both side faces of the actuator block 17, the actuator block 17 will operate in a well-balanced manner without tilting or becoming skewed when moved by the toggle lever 16.

The movable contactor 19 is a clip-shaped conductor comprising a flexible metal plate and has an upper portion formed to include an engagement portion 19-1 inserted into the retaining portion 18-2 of actuator block 17 from the side face thereof to be slidably engaged with and retained by the retaining portion. By virtue of this arrangement, the movable contactor 19 readily undergoes self-alignment in the recess 18 by adjusting its lateral position within the recess 18 by contacting with the stationary contacts 12 from one after another. The movable contactor 19 also has a tapered edge portion 19-2 to facilitate the transition from one stationary contact 12 to another and also to provide good contact by allowing the contact portion thereof to undergo wiping when the switch is operated.

The lower, central portion of the actuator block 17 is provided with a bore (not shown) in which the plunger 21 is slidably mounted, with a coil spring 20 being interposed between the upper end of the plunger 21 and the closed end of the bore. The arrangement is such that the coil spring 20 acts upon the plunger 21 to urge its distal end portion into abutting contact with the cam surface 11-3 formed on the upper face of the base 11 at its central portion. The expanded portion 16-1 of the toggle lever 16 has an O-ring 22 provided at its upper part on the outer periphery thereof.

Figure 7:
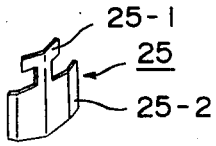
FIG. 7 is a perspective view showing a modification of a movable contactor employed in the miniature switch of FIG. 4.

It should be noted that the movable contactor need not necessarily be a clip-shaped resilient member of the type shown in FIGS. 5 and 6 but can be modified as shown in FIG. 7. The modified movable contactor, indicated here at numeral 25, comprises a single plate-like member bent slightly along its central longitudinal axis to assume a generally V-shaped configuration. The upper portion of the movable contactor 25 is provided with an engagement portion 25-1, and each side edge of the movable contactor 25 is provided with a tapered portion 25-2. The engagement portion 25-1 is engaged with the retaining portion 18-2 of actuator block 17. Thus, the arrangement is such that the movable contactor 25 need contact only the outer side of the stationary contacts 12.

Figure 1:
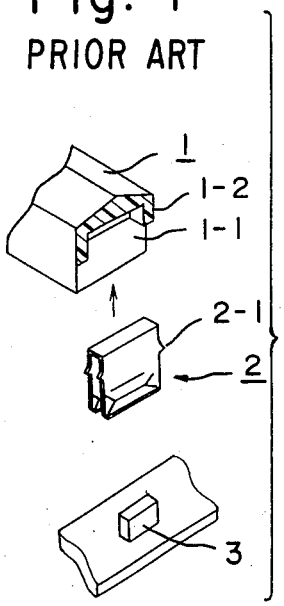
Fig. 1 PRIOR ART
FIG. 1 is a perspective view of a principle portion of a miniature switch according to the prior art and illustrates the mounting of a movable contactor.
Figure 2:
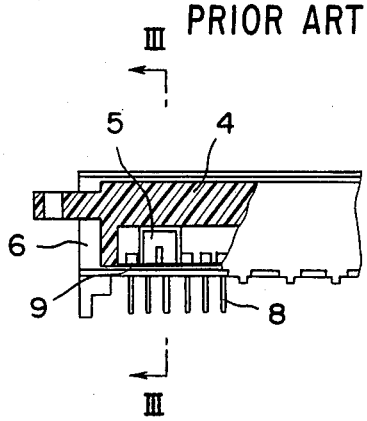
Fig. 2 PRIOR ART
FIG. 2 is a side view, partly in section, showing another example of a miniature switch according to the prior art.
Figure 3:
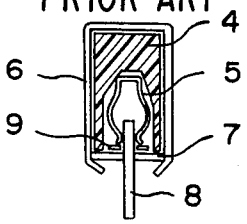
Fig. 3 PRIOR ART
FIG. 3 is a sectional view of the miniature switch of FIG. 2 taken along line III—III thereof.
Figure 8:
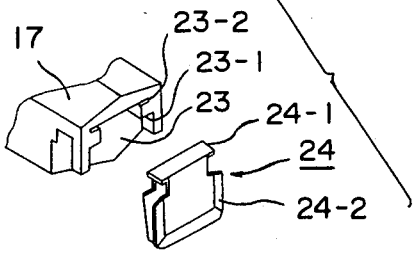
FIG. 8 is a perspective view showing a modification of a movable contactor and mounting portion thereof in the miniature switch of FIG. 4.

Another modification of the movable contactor is illustrated in FIG. 8. The movable contactor, here indicated at numeral 24, is similar to the movable contactor 19 of FIGS. 4 through 6 in that the contactor is a clip-shaped conductor comprising a resilient plate. The modification comprises the addition of a plate-shaped projection 24-1 extending laterally outward from the upper surface of the movable contactor 24 on its left and right sides. The movable contactor 24 also is tapered at 24-2, as in the embodiment of FIGS. 4 through 6. The side face of the actuator block 17 is formed to include a recess 23 provided with a step 23-1. The step 23-1 is provided with a retaining portion 23-2 formed to include a narrow groove for engaging the projection 24-1 of movable contactor 24. The projection 24-1 is loosely fitted into the retaining portion 23-2 of the actuator block 17.

The miniature switch of the present invention is assembled by mounting the movable contactor in the actuator block 17 in the manner set forth above, bringing the movable contactor into operative association with the stationary contacts 12, and thereafter mating the fitting projections 11-1, 11-2 of the base 11 with the fitting hole 14-1 and fitting recess 14-2, respectively, of the switch assembly 14. By assembling the switch in this manner, the inner surface 14-3 of switch housing 14 confronts the outer side of the movable contactor mounted in the actuator block 17, as shown in FIG. 6, and the recess 18 (23 in FIG. 8) is closed off by this inner surface 14-3. In other words, the movable contactor 19 (24, 25) is supported in a suspended state owing to the above-described engagement with the retaining portion 18-2 (23-2). In addition, the movable contactor is constrained by the stationary contacts 12 and the inner surface 14-3 of housing 14 and, hence, will not become detached from the actuator block 17.

The advantages of the present invention will now be set forth in detail.

(1) Adjustment of the fit between the movable contactor and actuator block is unnecessary and the movable contact can be readily mounted in the actuator block without being subjected to an excessive force. Moreover, the movable contactor can be retained by the actuator block in a positive and reliable manner.

(2) The movable contactor self-aligns to assure good electrical contact, even if the stationary contacts are in poor alignment.

(3) The movable contactor mounted in the actuator block is constrained by the inner wall surface of the switch housing. This prevents the movable contactor from becoming detached and therefore provides stable electrical contact without contact failure.

(4) Since the movable contactor is so mounted as to be suspended from the actuator block, stable electrical contact is provided without the base of the switch being damaged by the loosened contactor. This also enables the switch to be operated with ease to provide good operability.

(5) The switch has fewer component parts and is therefore less costly and smaller in size.

As many apparently widely different embodiments of the present invention can be made without departing from the spirit and scope thereof, it is to be understood that the invention is not limited to the specific embodiments thereof except as defined in the appended claims.

What we claim is:

1. A miniature switch with a self-aligning movable contactor comprising:

a base;

a plurality of first contactors fixed in and projecting from said base;

a switch housing provided with a bottom-opened chamber having a side wall, said switch housing being detachably engagable with said base;

an actuator block positioned for movement within said bottom-opened chamber of said switch housing;

an actuator member fixed on said actuator block;

at least one open recess provided in said actuator block, said open recess comprising a comparatively small upper portion and a comparatively large lower portion, said upper portion having a side opening and said lower portion having both front and rear openings and a side opening, wherein a retaining portion is provided at said upper portion; and a movable second contactor comprising a comparatively small upper portion and comparatively large lower portion, said upper portion being provided with an engagement portion, wherein said small upper portion of said movable second contactor is slidably inserted into said open recess through said small upper portion of said side opening without imparting any force to deform said movable second contactor in a manner such that said movable second contactor is merely suspended from said small upper part of said open recess by the engagement of the engagement portion thereof with said retaining portion so as to enable easy self-alignment by contacting with said first contactor, and wherein said side wall of said switch housing closes said side opening of said open recess when said switch housing engages with said base thereby maintaining said movable second contact in position within said actuator block.

2. The miniature switch according to claim 1, wherein said second contact means comprises a resilient plate formed in a clip-shaped configuration.

3. The miniature switch according to claim 1, wherein said second contact means comprises a tapered edge portion.

4. The miniature switch according to claim 1, wherein at least one open recess comprises an open recess at each side of said actuator block means.

* * * * *

UNITED STATES PATENT AND TRADEMARK OFFICE

CERTIFICATE OF CORRECTION

PATENT NO. : 4,725,702

DATED : February 16, 1988

INVENTOR(S) : Koji KAMISADA

It is certified that error appears in the above-identified patent and that said Letters Patent is hereby corrected as shown below:

On the cover page, after Item [76], the following should read:

--[73] Assignee: Nihon Kaiheiki Industrial Company Ltd., Tokyo, Japan--.

Signed and Sealed this

Sixth Day of September, 1988

*Attest:*

DONALD J. QUIGG

*Attesting Officer*

*Commissioner of Patents and Trademarks*